US011622620B1

(12) United States Patent
Tonjes

(10) Patent No.: US 11,622,620 B1
(45) Date of Patent: Apr. 11, 2023

(54) GAME PLAYER TABLE SYSTEM AND METHOD OF USE

(71) Applicant: Matthew Tonjes, Houston, TX (US)

(72) Inventor: Matthew Tonjes, Houston, TX (US)

( * ) Notice: Subject to any disclaimer, the term of this patent is extended or adjusted under 35 U.S.C. 154(b) by 0 days.

(21) Appl. No.: 17/031,320

(22) Filed: Sep. 24, 2020

(51) Int. Cl.
*A47B 3/00* (2006.01)
*A47B 13/16* (2006.01)
*A63F 3/00* (2006.01)

(52) U.S. Cl.
CPC ..... *A47B 3/002* (2013.01); *A47B 13/16* (2013.01); *A63F 3/00895* (2013.01); *A47B 2200/0036* (2013.01); *A63F 2003/00981* (2013.01)

(58) Field of Classification Search
CPC ..... A47B 23/041; A47B 3/002; A47B 3/083; A47B 2200/0083; A47B 2200/0036; A47B 2200/0037; A47B 3/00; A63F 3/00895; A63F 2003/00981; A63F 3/00
USPC ..... 108/115, 43, 44, 25, 165
See application file for complete search history.

(56) References Cited

U.S. PATENT DOCUMENTS 1,915,958 A * 6/1933 Skirrow ..... B60N 3/103 248/300
4,819,568 A * 4/1989 Coffrin ..... A47B 23/046 108/43
4,974,526 A * 12/1990 Wiygul, Jr. ..... A47B 3/002 108/157.1
5,088,419 A * 2/1992 Hartwell ..... A47B 3/083 108/166
5,322,021 A * 6/1994 Jackson ..... B60N 3/002 108/45
5,562,050 A * 10/1996 Colquhoun ..... A47B 3/002 312/258
5,590,939 A * 1/1997 Piontek ..... A47B 88/988 108/26
6,041,723 A * 3/2000 Peterson ..... A47B 5/06 108/115
6,314,892 B1 * 11/2001 Favini ..... A47B 3/0803 108/115
7,516,704 B2 * 4/2009 Snider ..... B44D 3/126 312/258
7,975,626 B1 * 7/2011 Wang ..... A47B 3/002 108/50.01
2003/0177960 A1 * 9/2003 Schenker ..... A47B 3/0803 108/115
2006/0096509 A1 * 5/2006 Liu ..... A47B 3/002 108/132
2010/0236452 A1 * 9/2010 Ruddy ..... B43L 3/005 108/6
2012/0228840 A1 * 9/2012 Qiang ..... A47B 3/002 280/42
2014/0165884 A1 * 6/2014 O'Gara ..... A47B 3/002 108/115

* cited by examiner

*Primary Examiner* — Jose V Chen
(74) *Attorney, Agent, or Firm* — Leavitt Eldredge Law Firm

(57) ABSTRACT

A game player table system is a portable and collapsible surface that is used by a single person or shared by a second person. A small flat surface that could hold cards, pieces, keys, phones, or the like so that they are not placed on the playing table and thereby cause distractions or penalties. Cup holders could also be used to hold beverages and prevent spills and damage from the spills to the game pieces.

3 Claims, 8 Drawing Sheets

GAME PLAYER TABLE SYSTEM AND METHOD OF USE

BACKGROUND

1. Field of the Invention

The present invention relates generally to table systems and methods, and more specifically, to a game player table system that holds drinks, plates, food, or other items for a person participating in a game or diversionary activity that sits on the floor out of the way of the activity.

2. Description of Related Art

Table systems are well known in the art and are effective means to provide a working surface that is commonly flat and elevated off the floor. For example, common tables have legs that hold a tabletop or working surface in a raised position so that it is at a height convent for use either while a person sits or stands. Tables are generally, fixed and reside in a single place for indefinite amounts of time. Other tables are designed to fold and be portable. Common portable tables replicate the conventional tables in their form and function which is rectangular in shape.

One of the problems commonly associated with common table systems is their limited use. For example, tables are generally large and do not allow for individual use or the addition of a table to an arrangement of tables so that when a person desires or requires an additional working surface where items can be placed, they are commonly set on the floor or the person's lap.

Accordingly, although great strides have been made in the area of table systems, many shortcomings remain.

DESCRIPTION OF THE DRAWINGS

The novel features believed characteristic of the embodiments of the present application are set forth in the appended claims. However, the embodiments themselves, as well as a preferred mode of use, and further objectives and advantages thereof, will best be understood by reference to the following detailed description when read in conjunction with the accompanying drawings, wherein:

Figure 1:
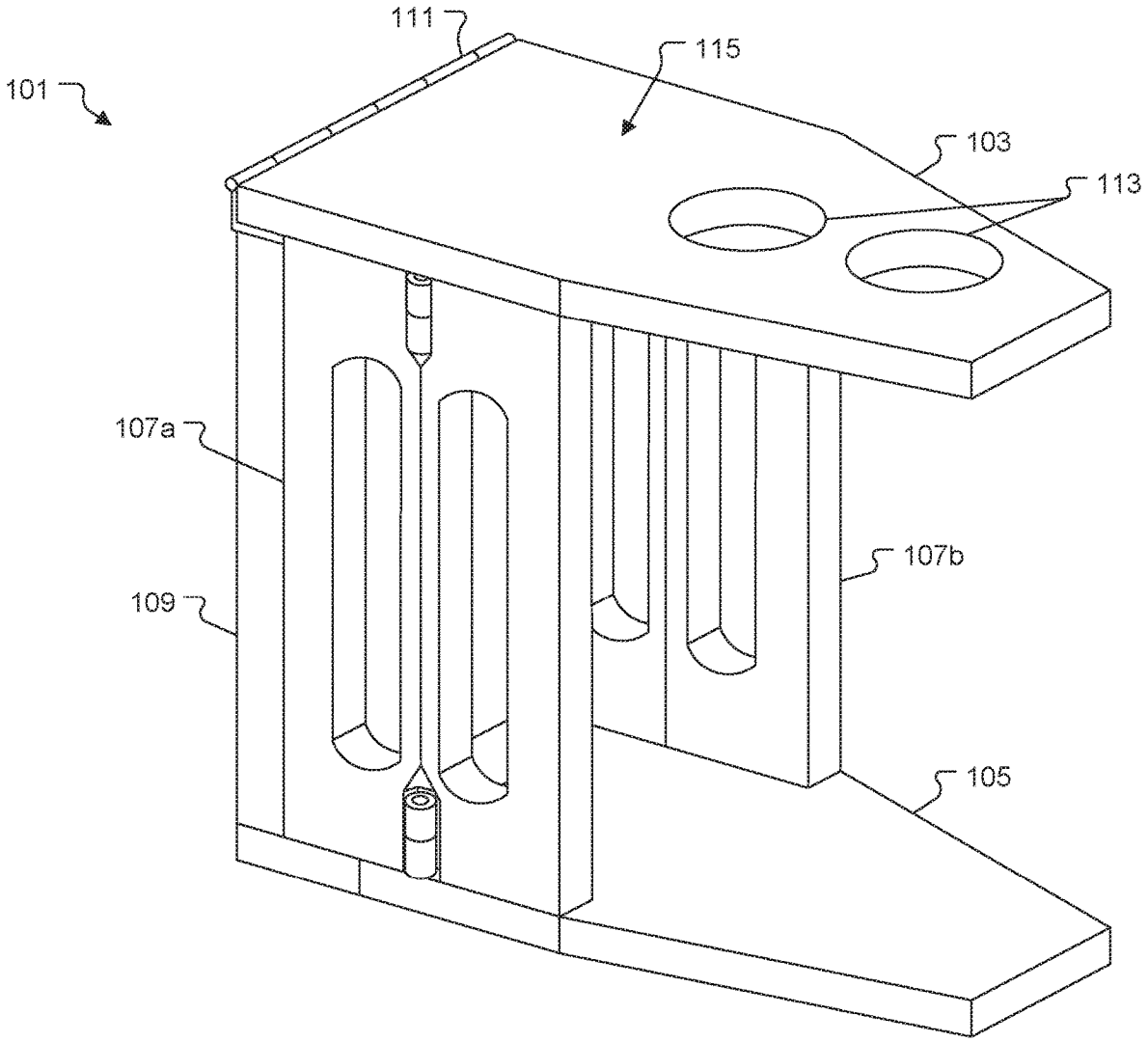
FIG. 1 is a front isometric view of a game player table system in accordance with a preferred embodiment of the present application.

While the system and method of use of the present application is susceptible to various modifications and alternative forms, specific embodiments thereof have been shown by way of example in the drawings and are herein described in detail. It should be understood, however, that the description herein of specific embodiments is not intended to limit the invention to the particular embodiment disclosed, but on the contrary, the intention is to cover all modifications, equivalents, and alternatives falling within the spirit and scope of the present application as defined by the appended claims.

DETAILED DESCRIPTION OF THE PREFERRED EMBODIMENT

Illustrative embodiments of the system and method of use of the present application are provided below. It will of course be appreciated that in the development of any actual embodiment, numerous implementation-specific decisions will be made to achieve the developer's specific goals, such as compliance with system-related and business-related constraints, which will vary from one implementation to another. Moreover, it will be appreciated that such a development effort might be complex and time-consuming but would nevertheless be a routine undertaking for those of ordinary skill in the art having the benefit of this disclosure.

The system and method of use in accordance with the present application overcomes one or more of the above-discussed problems commonly associated with conventional table systems. Specifically, the present invention creates the means to provide an additional working surface to a game player that can be used in conjunction with a common table where the additional working surface is non-continuous with the table. These and other unique features of the system and method of use are discussed below and illustrated in the accompanying drawings.

The system and method of use will be understood, both as to its structure and operation, from the accompanying drawings, taken in conjunction with the accompanying description. Several embodiments of the system are presented herein. It should be understood that various components, parts, and features of the different embodiments may be combined together and/or interchanged with one another, all of which are within the scope of the present application, even though not all variations and particular embodiments are shown in the drawings. It should also be understood that the mixing and matching of features, elements, and/or functions between various embodiments is expressly contemplated herein so that one of ordinary skill in the art would appreciate from this disclosure that the features, elements, and/or functions of one embodiment may be incorporated into another embodiment as appropriate, unless described otherwise.

The preferred embodiment herein described is not intended to be exhaustive or to limit the invention to the precise form disclosed. It is chosen and described to explain the principles of the invention and its application and practical use to enable others skilled in the art to follow its teachings.

Referring now to the drawings wherein like reference characters identify corresponding or similar elements throughout the several views, FIG. 1 depicts a front isometric view of a game player table system in accordance with a preferred embodiment of the present application. It will be appreciated that system 101 overcomes one or more of the above-listed problems commonly associated with conventional table systems.

In the contemplated embodiment, system 101 includes a deck body 103 pivotally attached to a back support body 109 via a hinge 111. The back support body 109 is also pivotally attached to a foot support body 105 via a hinge. The back support 109 further is attached to side support bodies 107 via hinges 401. The deck body 103 includes drink holders 113 and a flat surface 115.

Figure 2:
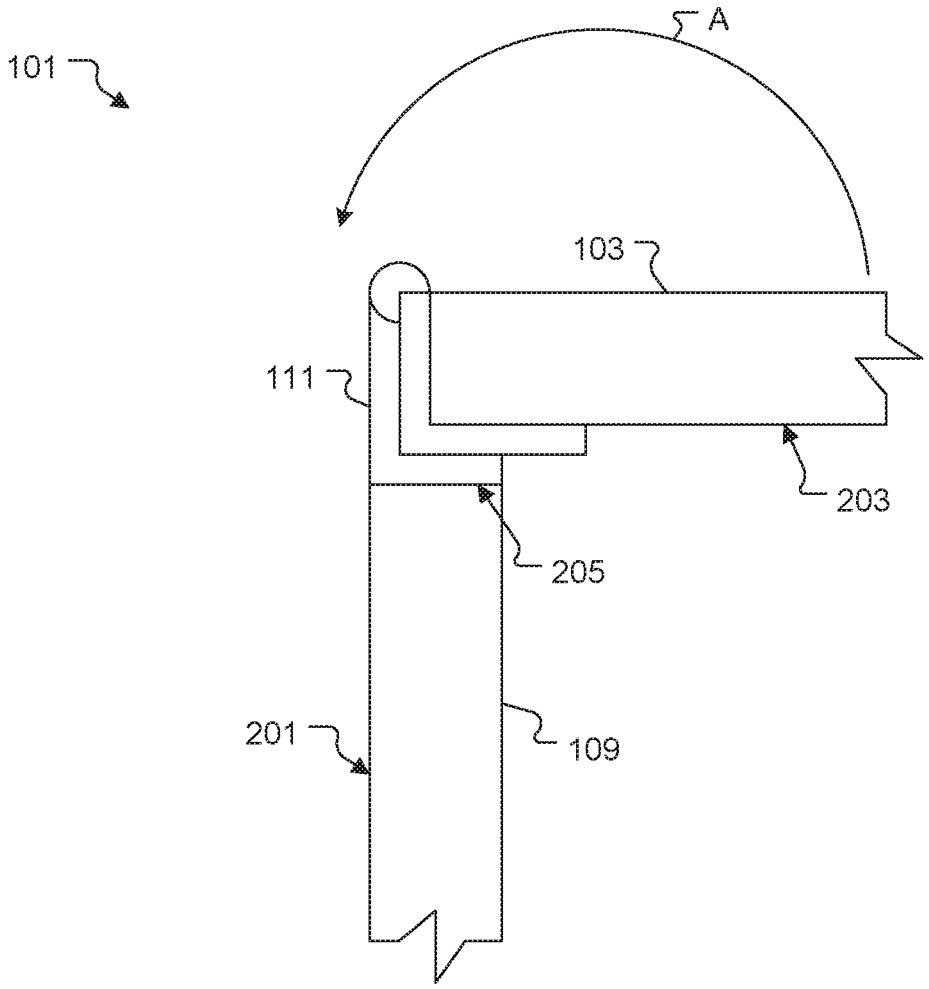
FIG. 2 is a side view of the deck body and back support body of FIG. 1.

As depicted by FIG. 2, the deck body 103 is attached to the back support body 109 via hinge 111. The hinge 111 is attached to the top surface 205 of the back support body 109 and to the bottom surface 203 of the deck body 103. The deck body 103, when pivoted, as depicted by motion A about the hinge 111 that the deck body 103 comes to rest next to the rear surface 201 of the back support body 109.

Figure 3:
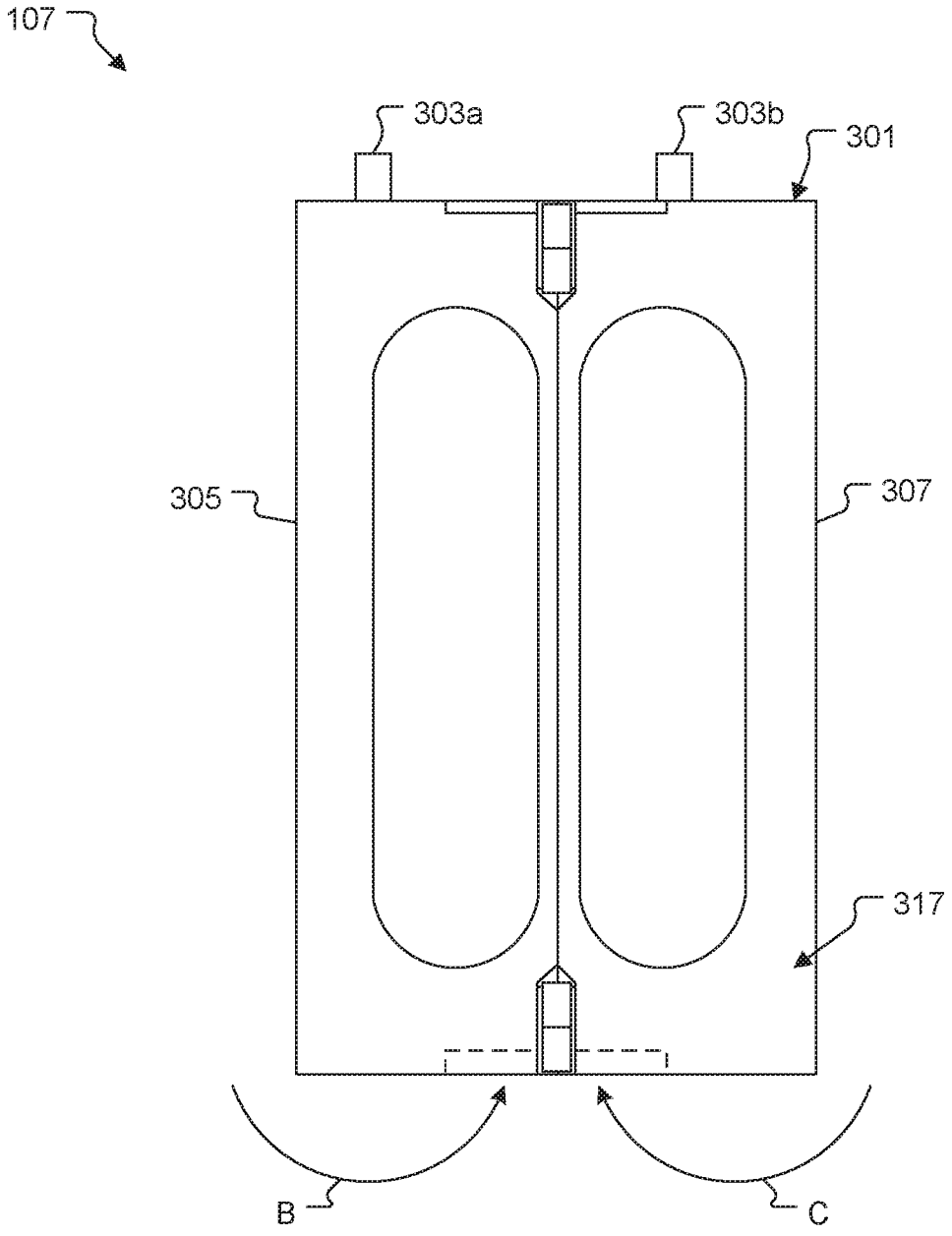
FIG. 3 is a side view of a side support body of FIG. 1.

In the preferred embodiment as depicted by FIG. 3 the side support bodies 107 include pins 303 on the top surface 305 of thereof that are configured to enter corresponding holes in the deck body 103 to add stiffness to the system 101. The side support body 107 includes a first panel 305 and a second panel 307 that are attached via a first hinge 309 and a second hinge 311. The first hinge 309 is set within a first cutout 313 and the second hinge 311 is set within a second cutout 315 so that the first panel 305 and second panel 307 fold as depicted by motions B and C contact each other completely on their outer surfaces 317.

Figure 4:
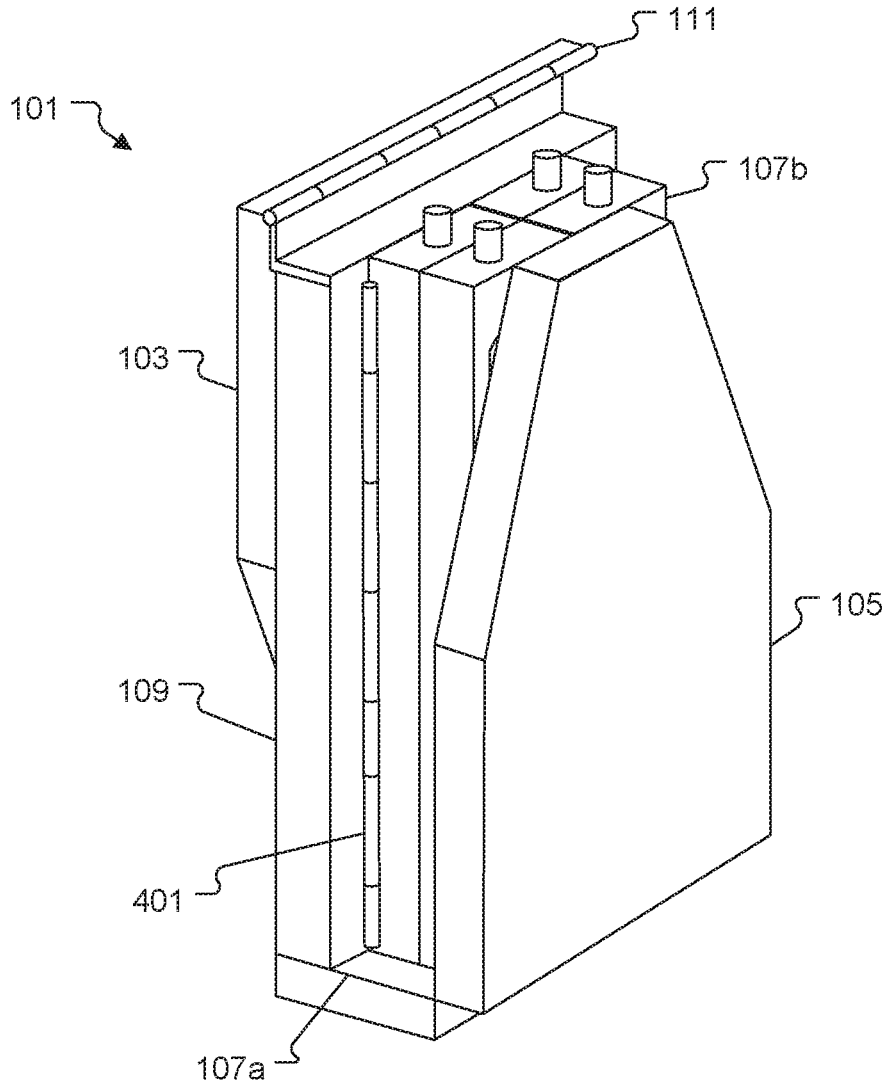
FIG. 4 is a front isometric view of the system of FIG. 1 in its folded position.

The system 101 is configured so that the deck body 103, side support bodies 107, and foot support body 105 fold to allow the system 101 to be transported in a brick style shape as depicted by FIG. 4. It is contemplated that in this way the system occupies a minimal amount of space while in transport.

In use, the system 101 is carried by a person to the location where it will be deployed. The foot support body 105 is folded down, the side support bodies 107 are folded out, the deck body 103 is flipped over and attached to the side support bodies 107. The flat surface 115 is used to hold items placed there by the person and the cup holders 113 retain a beverage container therein.

It should be appreciated that one of the unique features believed characteristic of the present application is that the deck body 103 provides additional flat surface 115 to be used by a game player to hold items not in use during the current game.

Additionally, the cup holders 113 allow the player to store beverage thereon so that they are not on the floor.

It is also believed that the pivotable support bodies allow the invention to quickly break down to allow for efficient transportation of the system 101.

Figure 5A:
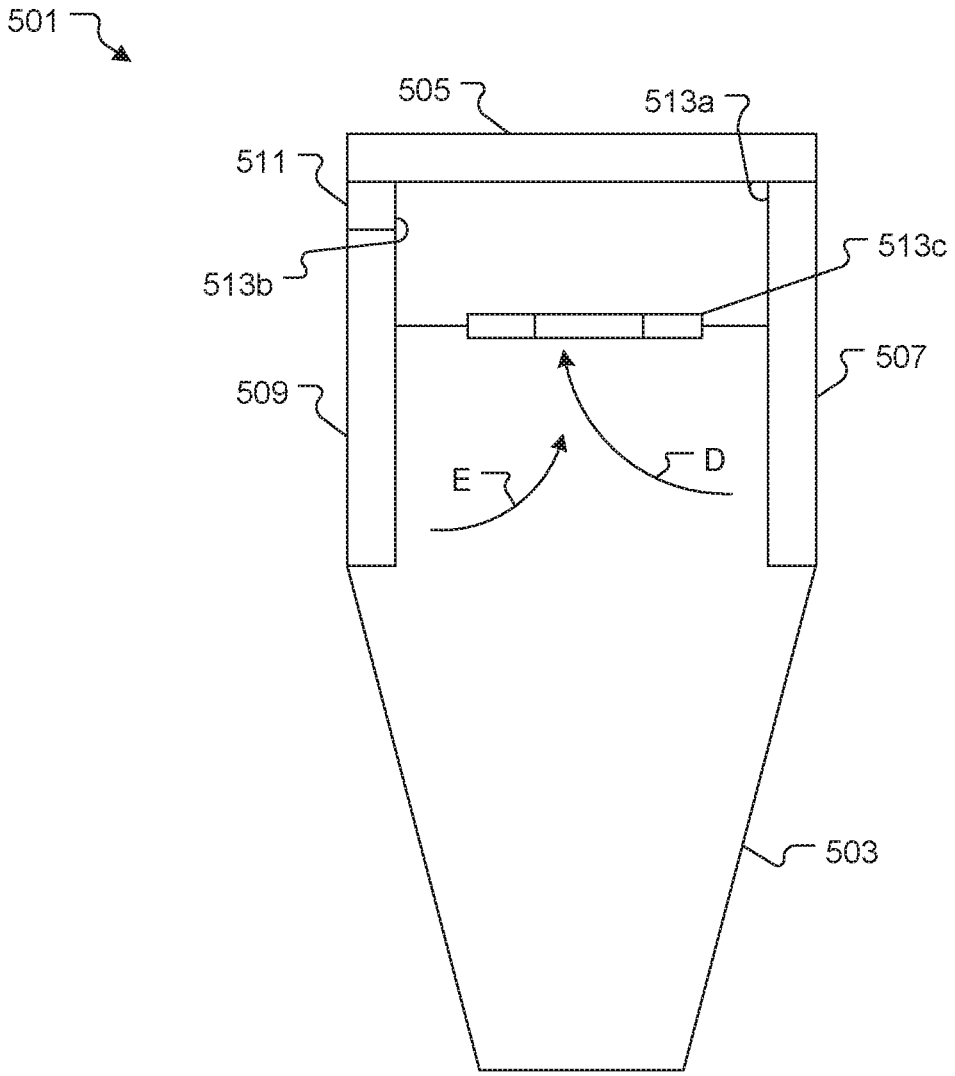
FIGS. 5A, 5B, and 5C are top views of an alternative embodiment of the system of FIG. 1.
Figure 5B:
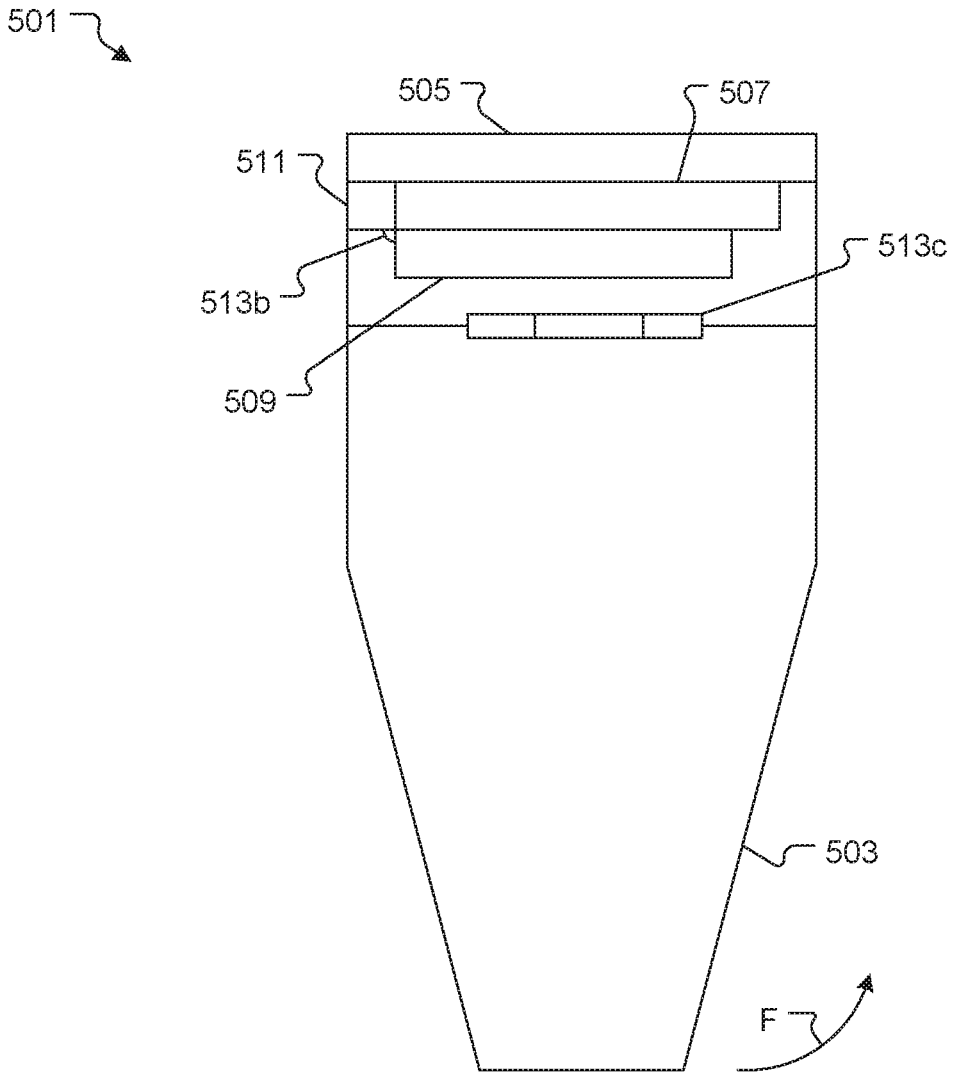
Figure 5C:
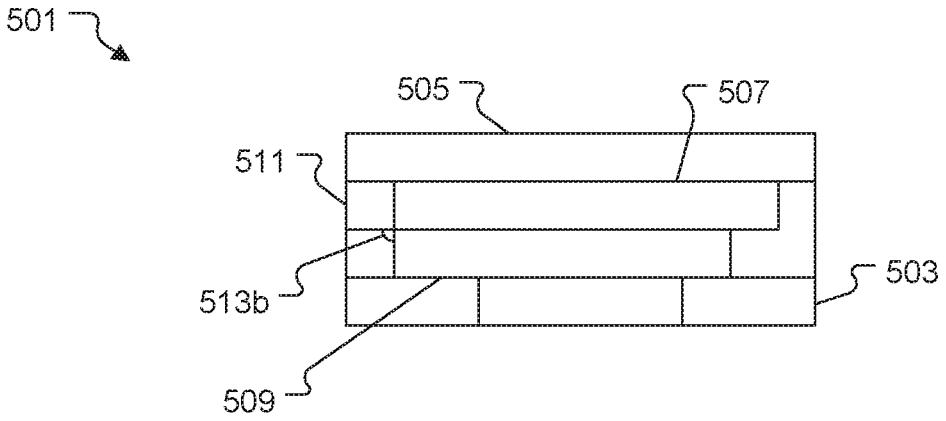

Referring now to FIGS. 5A, 5B, and 5C where an alternative embodiment of the system 101 is depicted. For clarity, the deck body is removed but attached to the back support body 505 similar to that of system 101. Embodiment 501 includes a back support body 505 that is attached to a foot support body 503. The foot support body 503 has hinged join therein that allows for a part to remain stationary and the remainder to pivot about hinge 513. A first side support body 507 is pivotally attached to the back support body 505 via a hinge 513 so that the entirety thereof pivots against the back support body 505. A second side support body 509 is pivotally attached to a spacer body 511 that is attached to the back support body 505. The second side support body 509 and spacer body 511 are attached via a hinge 513.

As depicted by motion D it is contemplated that the first side support body 507 folds against the back support body 505. The second side support body 509 folds as depicted by motion E against the first side support body 507. The remainder of the foot support body 503 folds up as depicted by motion F so that it contacts the second side support body 509.

Figure 6:
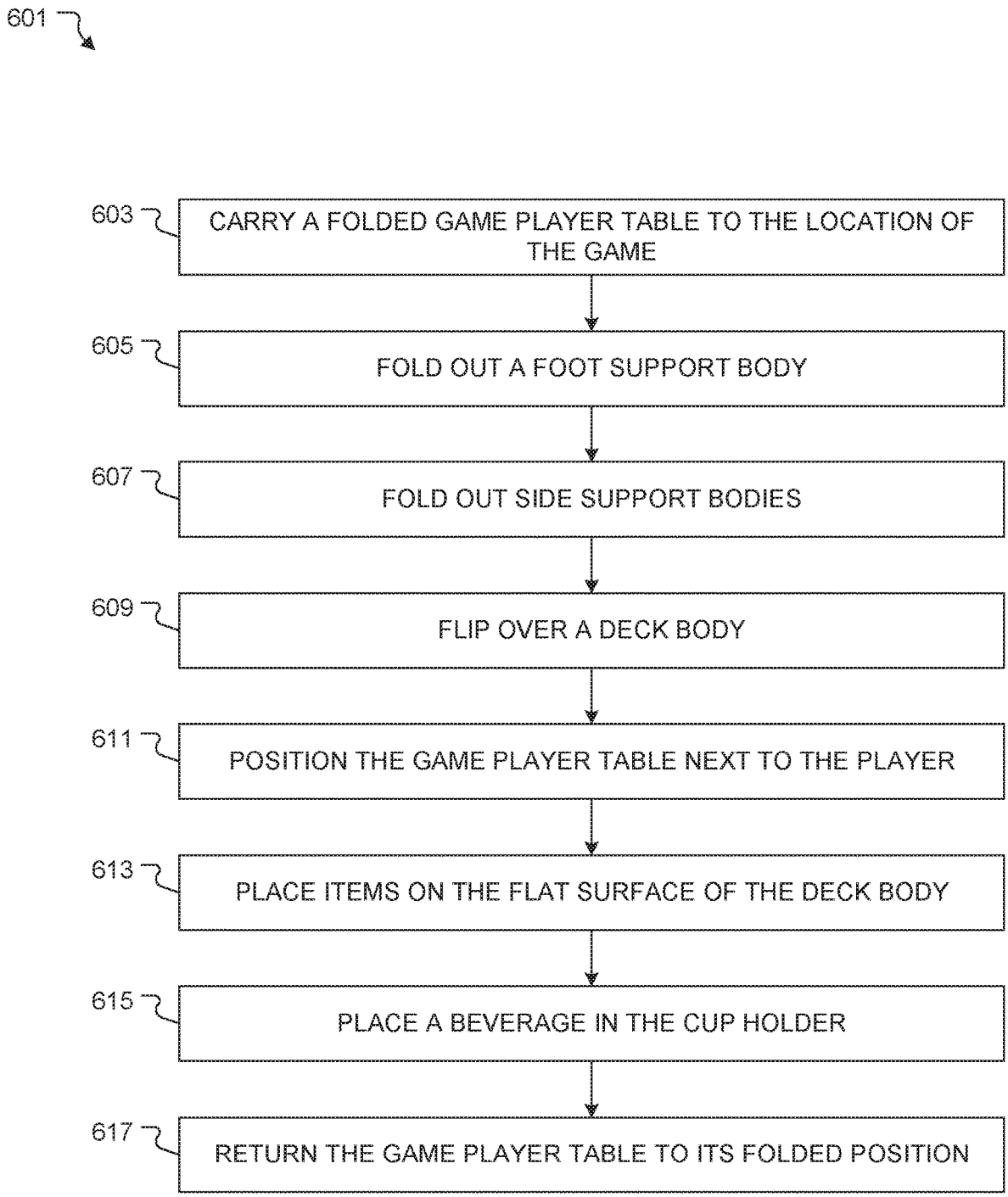
FIG. 6 is a flowchart of a method of providing additional table space.

Referring now to FIG. 6 a method of providing additional table space is depicted. Method 601 includes carrying a folded game player table to the location of the game 603, folding out a foot support body 605, folding out side support bodies 607, flipping over a deck body 609, positioning the game player table next to the player 611, placing items on the flat surface of the deck body 613, placing beverages in a cup holder 615, and returning the game player table to its folded position 617.

The particular embodiments disclosed above are illustrative only, as the embodiments may be modified and practiced in different but equivalent manners apparent to those skilled in the art having the benefit of the teachings herein. It is therefore evident that the particular embodiments disclosed above may be altered or modified, and all such variations are considered within the scope and spirit of the application. Accordingly, the protection sought herein is as set forth in the description. Although the present embodiments are shown above, they are not limited to just these embodiments, but are amenable to various changes and modifications without departing from the spirit thereof.

What is claimed:

1. A game player table system comprising:

at least one deck body pivotally attached to at least one back support body;

at least one side support body having a top pivotally attached to the back support body, the at least one side support body having a plurality of pins at the top and configured to releasably couple with the at least one deck body; and at least one foot support body pivotally attached to the back support body;

wherein the deck body, back support body, side support body and foot body fold together to form brick style shape for transport; and wherein the deck body has at least one flat surface.

2. The system of claim 1 wherein the deck body includes at least one cup holder therein.

3. The system of claim 1 wherein the deck body includes at least one cup holder therein.

* * * * *